United States Patent [19]

Hoffmann et al.

[11] Patent Number: 4,518,006

[45] Date of Patent: May 21, 1985

[54] BACKFLOW-PREVENTING VALVE

[75] Inventors: Peter Hoffmann, Bernhaupten; Walter Evers, Ennepetal, both of Fed. Rep. of Germany

[73] Assignee: Lang Apparatebau GmbH, Siegsdorf, Fed. Rep. of Germany

[21] Appl. No.: 474,744

[22] Filed: Mar. 10, 1983

[30] Foreign Application Priority Data

Mar. 15, 1982 [DE] Fed. Rep. of Germany ... 8207222[U]

[51] Int. Cl.[3] ..... F16K 15/20

[52] U.S. Cl. ..... 137/218; 137/107

[58] Field of Search ..... 137/216, 217, 218, 107

[56] References Cited

U.S. PATENT DOCUMENTS

| | | | |
|---|---|---|---|
| 2,953,153 | 9/1960 | Gaul | 137/107 |
| 3,083,723 | 4/1963 | Duchin | 137/218 |
| 3,114,382 | 12/1963 | Cantor | 137/218 |
| 3,905,382 | 9/1975 | Waterston | 137/218 |
| 4,013,088 | 3/1977 | Gocke et al. | 137/218 |
| 4,044,787 | 8/1977 | Sutherland | 137/107 |
| 4,159,025 | 6/1979 | Harthun | 137/218 |
| 4,232,704 | 11/1980 | Becker et al. | 137/218 |
| 4,332,274 | 6/1982 | Frisquet | 137/218 |

FOREIGN PATENT DOCUMENTS

| | | |
|---|---|---|
| 2418035 | 1/1978 | Fed. Rep. of Germany . |
| 2747941 | 5/1979 | Fed. Rep. of Germany . |

*Primary Examiner*—Edward G. Favors
*Assistant Examiner*—Steven E. Warner
*Attorney, Agent, or Firm*—Karl F. Ross; Herbert Dubno

[57] ABSTRACT

A backflow-preventing valve for connection between a high-pressure input line and a lower-pressure output line has a valve housing forming upstream and downstream chambers and having an inlet opening into the upstream chamber remote from the downstream chamber, a vent opening into the upstream chamber offset from the inlet, and an outlet opening into the downstream chamber. A check valve in the downstream chamber allows flow only from the upstream chamber into the downstream chamber. A tubular piston sealingly engaged across the upstream chamber upstream of the vent, formed with a throughgoing bore, and having a downstream end engageable with the check valve is movable between an upstream position with its downstream end in the upstream chamber spaced from the check valve and a downstream position with its downstream end engaged sealingly with the check valve. Fluid flow through the bore from the inlet to the vent is only possible in and between the upstream position and an intermediate position of the piston. A spring urges the piston into the upstream position. A valve body fixed in the housing and sealingly engageable in the piston bore in and between the intermediate and upstream positions of the piston subdivides the upstream chamber into an upstream compartment into which the inlet opens and a downstream compartment into which the outlet and downstream chamber open. This valve body is spaced from the piston and permits free fluid exchange between the compartments between the downstream and intermediate positions of the piston and is formed with a small-diameter bleed passage opening at one side in the upstream compartment and at the other side in the downstream compartment.

7 Claims, 1 Drawing Figure

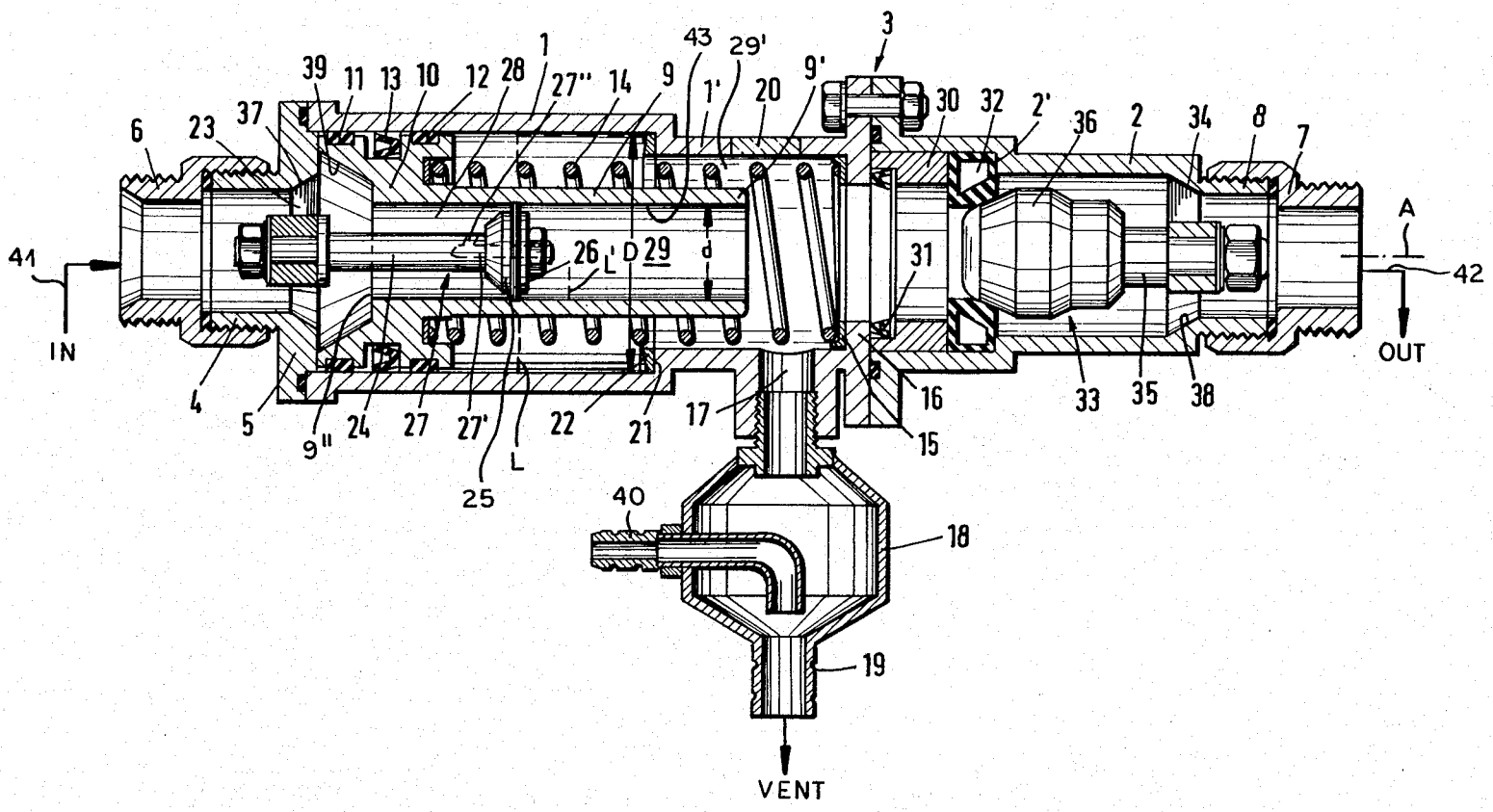
OUT
VENT
IN
A
L
L'
D
d

BACKFLOW-PREVENTING VALVE

FIELD OF THE INVENTION

The present invention relates to a backflow preventer. More particularly this invention concerns a backflow-preventing valve used to isolate a service line from a drinking-water main in the event of a pressure reversal therebetween.

BACKGROUND OF THE INVENTION

A backflow preventer is used to prevent possibly contaminated water from a service line from flowing back into a main line in case a reverse pressure differential occurs between the service line and main line. Thus if the pressure in the main line drops precipitously, due for example to use of a nearby fire hydrant, so that its pressure falls below that of a service line water will not be sucked by the main line back from the service line. Similarly if the pressure downstream of a backflow preventer increases, as for instance when a boiler having an automatic-fill connection to the water system fails and overheats, the backflow preventer should prevent this certainly unsavory water from reentering the drinking-water main.

Typically such a valve has a downstream or outlet chamber connected to the service line and provided with a simple spring-loaded check valve that substantially blocks reverse flow back from the service line. Its downstream or inlet side is connected to the normally high-pressure main and its center has an externally open vent that is downstream of the outlet-chamber check valve. Some sort of valve structure is provided in a downstream or inlet chamber formed in the valve housing and into which the main and the vent open and which is partially defined by the downstream end of the check valve. The valve body in this inlet chamber is actuated by pressure to vent the downstream chamber when pressure in the main line drops below a predetermined level, thereby creating in theory a zero-pressure compartment between the main and service line, both of which are under some pressure, so that fluid exchange between them is virtually impossible.

In order also thus to sever the connection when, for instance, flow in the main line is suddenly stopped without a corresponding rapid decrease in pressure, it is preferred to provide some sort of bleed arrangement which reduces pressure at least upstream of the valve as a safety precaution. German patent document No. 2,418,035 (equivalent U.S. Pat. No. 3,903,916) describes a bleed passage, and German patent document No. 2,747,941 a bleed valve used for this purpose.

Typically such valves are complicated and expensive. A separate hydraulic mechanism or electric energization is needed for operation. Furthermore they are known to jam and fail by not shutting down the line when necessary, due mainly to a failure of delicate mechanism. A final problem with such backflow-preventing valves is that they constitute a considerable obstruction to flow themselves, so that they must be dimensioned quite large even to control a small line in order to permit low-resistance flow.

OBJECTS OF THE INVENTION

It is therefore an object of the present invention to provide an improved backflow-preventing valve.

Another object is the provision of such a backflow-preventing valve which overcomes the above-given disadvantages.

Thus it is an object to provide a backflow preventer which is relatively simple in construction so that it can be counted on to operate for a long time and so that it is cheap in construction.

Yet another object is the provision of a backflow preventer which presents minimal resistance to flow through it when in the normal open position.

SUMMARY OF THE INVENTION

These objects are attained according to the instant invention in a backflow-preventing valve for connection between a normally relatively high-pressure input line and a lower-pressure output line which has a valve housing forming an upstream chamber and a downstream chamber and having an inlet opening into the upstream chamber remote from the downstream chamber, a vent opening into the upstream chamber offset from the inlet, and an outlet opening into the downstream chamber. Means including a check valve in the downstream chamber allows flow from the upstream chamber into the downstream chamber and blocks flow from the downstream chamber into the upstream chamber. A tubular piston sealingly engaged across the upstream chamber upstream of the vent, formed with a throughgoing bore, and having a downstream end engageable with the check valve is movable between an upstream position with its downstream end in the upstream chamber spaced from the check valve and a downstream position with its downstream end engaged sealingly with the check valve and through an intermediate position with its downstream end spaced upstream of the check valve. Fluid flow through the bore from the inlet to the vent is only possible in and between the upstream and intermediate positions. A spring braced between the piston and the valve housing urges the piston into the upstream position. A valve body fixed in the housing and sealingly engageable in the piston bore in and between the intermediate and upstream positions of the piston subdivides the upstream chamber into an upstream compartment into which the inlet opens and a downstream compartment into which the outlet and downstream chamber open. This valve body is spaced from the piston and permits free fluid exchange between the compartments between the downstream and intermediate positions of the piston. In addition it is formed with a small-diameter bleed passage opening at one side in the upstream compartment and at the other side in the downstream compartment.

According to this invention the piston and housing are generally centered on an axis extending from the inlet to the outlet and the valve body is provided with a mounting stem extending axially along the piston bore toward the inlet and secured to the housing. The passage has a downstream end opening axially into the downstream compartment and an upstream end opening radially into the upstream compartment on the stem. The bleed passage further has a flow cross section that is a very small fraction of that defined between the piston and the body in the downstream position of the piston.

With this system it is possible to achieve very smooth flow through the valve. In addition bleeding through the valve body rather than around the piston can take place without affecting the displacement or guiding of the piston. Since the flow cross section of the bleed passage is quite small, it will not appreciably slow operation of the valve since pressure upstream of it can build up quickly, but at the same time it will reduce pressure upstream if the main is blocked, ensuring that even without a pressure drop in the main the valve will vent the middle compartment should flow stop.

In accordance with yet another feature of this invention the piston and housing are generally centered on an axis extending from the inlet to the outlet and the valve body is provided with a mounting stem extending axially along the piston bore toward the inlet and secured to the housing. The piston has an upstream end formed as a generally cylindrical flange centered on the axis and having a pair of axially spaced seal rings snugly engaging the inner wall of the valve housing in the upstream chamber. This piston flange is provided between the seal rings with a U-section gland concave upstream toward the inlet and snugly engaging the inner wall. As a result there is absolutely no flow around the piston so that, according to another feature this invention the spring is a coil spring surrounding the tubular piston and substantially out of the path of flow through the valve housing. This spring therefore will not become fouled and will therefore have a long service life. What is more, the piston will effectively scrape the inner wall of the upstream chamber each time the valve operates, thereby eliminating lime and similar deposits. The system is therefore self-cleaning.

The check valve according to the invention includes an annular seat generally between the chambers and defining a flow passage therebetween, a valve body displaceable downstream toward the outlet away from the seat and upstream toward and into sealing engagement with the seat, and mounting means urging the valve body downstream against the seat. Such structure will operate surely and have a long service life.

DESCRIPTION OF THE DRAWING

The above and other features and advantages will become more readily apparent from the following, reference being made to the accompanying drawing whose sole FIGURE is a partially diagrammatic axial section through the valve according to the present invention.

SPECIFIC DESCRIPTION

As seen in the drawing a backflow-preventing valve has a housing comprised of a cylindrically stepped upstream part 1 centered on an axis A, and a cylindrically stepped downstream part 2 also centered on the axis A and secured to the part 1 at a flange joint 3. The upstream part 1 is fitted with a cap 5 that has a male inlet nipple 4 provided with a male-male connection nut 6 connected to a normally high-pressure main indicated diagrammatically at 41. The downstream part 2 has a male outlet nipple 8 provided with a male-male connection nut 7 connected to a normally lower-pressure outlet service line indicated diagrammatically at 42 and axially in line with the main 41.

The upstream part 1 is provided with a tubular piston 9 having an axially throughgoing cylindrical bore 43 centered on the axis A. In addition the piston 9 has a large-diameter upstream flange 10 sealed against the cylindrical inner surface of the part 1 by means of O-rings 11 and 12 flanking a gland 13 that is U-shaped upstream, so that leakage around the flange 10 is impossible, yet the piston 9 can move axially relatively easily in the part 1. A helical compression spring 14 is braced axially against the downstream face of the flange 10 and a spring ring 15 sitting on a shoulder 16 at the downstream end of the upstream part 1. The piston 9 can therefore move against the force of this spring 14 downstream until the downstream face of the flange 10 lies against a cushion ring 22 sitting on a shoulder 21 defined at the upstream end of a downstream portion 1' of the part. This portion 1 is of an intermediate diameter that is the same as that of the upstream portion of the downstream part 2. In this position the upstream face of the piston 9 lies at a level indicated at L.

Opening into the extreme downstream end of the upstream part 1 is a vent passage 17 provided with a large-diameter vent cup 18 having an outlet 19 and an air intake 40. Opposite the vent 17 is a transparent window 20 allowing one to check the postion of the piston 9 from outside the valve.

Struts 23 in the cap 5 are secured to the upstream end of a rod 24 carrying at its downstream end a valve body 25 having a seal ring 26 sealingly engaging the inner surface of the tubular piston 9 and effectively blocking flow through the piston bore 43 in the illustrated upstream position of the piston 9. The O-ring 26 is positioned slightly downstream of the level L.

The upstream face of the piston 9 is formed with a frustoconical recess 39 whose base 9'' lies in the downstream position of the piston 9 at a level L' downstream of the level L and of the ring 26. Thus when the piston 9 is in any position somewhat upstream of its extreme downstream position, it and the valve body 25 subdivide the interior of the upstream part 1 into an upstream compartment 28 into which the main line 41 feeds and a downstream compartment 29 into which the vent 17 opens and which itself opens into the downstream part 2. A bleed passage 27 formed in the stem 24 has an axial leg 27' opening into the compartment 29 and a radial leg 27'' opening upstream of the valve body 15 into the compartment 28 for limited fluid communication between these compartments 28 and 29 regardless of the position of the piston 9.

The upstream end of the downstream part 2 is provided with an L-section abutment ring 30 holding a gland 31 that is U-section and open downstream against the downstream end of the part 1. In addition a large hollow-section seal and seat ring 32 is sandwiched between this abutment ring 30 and a shoulder 2 subdividing the downstream part into an intermediate-diameter upstream portion and a small-diameter downstream portion. Struts 34 are secured to the upper end of a spring-loaded rod 35 supporting a valve member or head 36 forming with the ring 32 a check valve 33. The head 36 can move axially on the spring-loaded rod 35 toward and away from the ring 32 to block flow through this ring 32 when the pressure downstream of it does not exceed the pressure upstream of it by the spring force loading the head 36.

In the size-transition regions of the valve housing 1—8, that is at the struts 23 and at the struts 34, the housing is formed with frustoconical transition surfaces 37 and 38 that respectively taper upstream and downstream. Similarly the frustoconical recess 39 tapers downstream. The piston bore 43 is of the same circular flow cross section as the inlet and outlet fittings 6 and 7 and the annular flow cross section defined between the outer edge of the valve body 25 and the inner edge of the bore 43 at the upstream piston end face 9'' is at least this large. Thus resistance to flow is minimized through the valve of this invention. The flow cross section of the passage 27 is very small, compared to that is at most a tenth or twentieth, that of the bore 43 and similarly much smaller than that of the outlet 17 so this outlet 17 can easily handle the flow through the passage 27.

In the illustrated position of the valve there is no appreciable pressure in the main 41 and some pressure at least in the downstream service line 42. Thus the check valve 33 is closed, with the head 36 snugly against the seat ring 32. In addition the spring 14 is pressing the piston 9 upstream against the cap 5 so that the valve body 25 is firmly lodged in the bore or bore 43. The only fluid flow is through the passage 27 from the upstream compartment 28 to the downstream compartment 29. This flow exits from the part 1 through the vent opening 17.

Assuming pressure increases in the line 41 at a rate greater than that which can be dissipated through the bleed passage 27, the piston 9 will be moved downstream against the force of its spring 14. During such movement the valve body 25 will move toward the upstream piston end while there is still only minimal fluid flow through the passage 27.

Next the downstream end 9′ of the tubular piston 9 will enter the gland 31, thereby cutting off the interior of the piston 9 and simultaneously stopping the liquid passing through the passage 27 from exiting from the part 1 via the vent 17. The annular chamber 29′ formed around and downstream of the piston 9 in the part 1 thus remains at ambient pressure, while pressure downstream of the valve body 25 in the downstream compartment 29 and in the bore 43 builds up.

Finally the upstream end 9″ of the bore of the piston 9 pulls downstream past the valve body 25 so that the compartments 28 and 29 will communicate around the valve body 25 and at about the same time the downstream end 9′ of the piston 9 will engage the seat ring 32. The full watermain pressure will be applied to the upstream face of the valve body 36 to open the valve 33 and restore fluid communication between the lines 41 and 42. Since the interior of the piston 9 has been pressurizing through the chamber 27 during travel of the downstream end 9′ from the ring 31 to the ring 32, the valve 33 is opened gently, not with a sudden snap as the O-ring 26 of the valve body 25 clears the surface 9″. In fact if the pressure in the main is increasing slowly, the pressure bleeding through the bore from the upstream compartment to the downstream compartment will be sufficiently great to open the check valve 33 even before the valve ring 26 pulls clear of the piston face 9″.

Should the pressure then increase in the line 42 above that in the line 41 the valve 33 will close and prevent backflow. In this position the piston 9 will remain toward the right, that is in the downstream position, so that the outer downstream compartment 29′ is sealed of from the compartment 29 inside the bore 43. Fluid flow in reverse in this condition, which is a relatively rare occurrence, is thus prevented, since the valve 33 can be counted on to seal very tightly.

If, in the downstream position of the piston 9 and closed position of the valve 33, the pressure in the line 41 drops below that in the line 42 the valve 33 will similarly close. If in addition the mains pressure upstream of the piston 9 decreases below a level mainly determined by the force of the spring 14 the piston 9 will pull back downstream, an action that normally only takes place when the valve 33 is closed. As the piston 9 moves back past the seal 31 it will vent the compartment 29, thereby completely cutting the fluid connection between the lines 41 and 42 and locking the valve 33 shut with the pressure differential between ambient pressure in the outer subcompartment 29′ and that in the service line 42. Continued minor flow through the passage 27 will prevent minor pressure fluctuations downstream of the piston 9 from unnecessarily actuating the valve and such flow will easily exit from the valve from the outlet 17.

This system therefore operates smoothly and surely. All motion is axial and in fact there are only two moving parts, the valve head 36 and the piston 9. When open the flow cross section of the valve is at its smallest as great as its inlet and output nipples 4 and 8 so that there will be at most a minor pressure drop in the arrangement caused principally by the springs loading the piston 9 and valve head 36. In addition flow is substantially all axial through the valve, deflecting outward annularly around the valve body 25 and head 36, so that pressure losses in this valve are minimal. In addition flow through the valve is in a straight line, along the axis A, so that the system can easily be built into a plumbing system at any location where there is a convenient place to attach the vent unit 18.

We claim:

1. A backflow-preventing valve for connection between a normally relatively high-pressure input line and a lower-pressure output line, the valve comprising:

a valve housing forming an upstream chamber and a downstream chamber and having an inlet opening into the upstream chamber remote from the downstream chamber, a vent opening into the upstream chamber offset from the inlet, and an outlet opening into the downstream chamber, the inlet normally being connected to the high-pressure input line, the outlet normally being connected to the lower-pressure output line, and the vent being open to the outside;

means including a check valve in the downstream chamber for allowing flow from the upstream chamber into the downstream chamber and for blocking flow from the downstream chamber into the upstream chamber;

a tubular piston sealingly engaged across the upstream chamber upstream of the vent, formed with a throughgoing bore, and having a downstream end sealingly engageable in the downstream chamber, the piston being movable between an upstream position with its downstream end in the upstream chamber spaced from the downstream chamber and a downstream position with its downstream end engaged sealingly in the downstream chamber and through an intermediate position with its downstream end spaced upstream of the downstream chamber, fluid flow through the bore from the inlet to the vent only being possible in and between the upstream and intermediate positions, fluid flow between the inlet and the vent and between the outlet and the vent being blocked by the piston in its downstream position;

a spring braced between the piston and the valve housing and urging the piston into the upstream position; and a valve body fixed in the housing and sealingly engageable in the piston bore in and between the intermediate and upstream positions of the piston to subdivide the upstream chamber into an upstream compartment into which the inlet opens and a downstream compartment into which the vent and downstream chamber open, the valve body being spaced from the piston and permitting free fluid exchange between the compartments between the downstream and intermediate positions of the piston, the valve body being formed with a small-diameter bleed passage opening at one side in the upstream compartment and at the other side in the downstream compartment.

2. The backflow-preventing valve defined in claim 1 wherein the piston and housing are generally centered on an axis extending from the inlet to the outlet and the valve body is provided with a mounting stem extending axially along the piston bore toward the inlet and secured to the housing, the passage having a downstream end opening axially into the downstream compartment and an upstream end opening radially into the upstream compartment on the stem.

3. The backflow-preventing valve defined in claim 2 wherein the bleed passage has a flow cross section that is a very small fraction of that defined between the piston and the body in the downstream position of the piston.

4. The backflow-preventing valve defined in claim 1 wherein the piston and housing are generally centered on an axis extending from the inlet to the outlet and the valve body is provided with a mounting stem extending axially along the piston bore toward the inlet and secured to the housing, the piston having an upstream end formed as a generally cylindrical flange centered on the axis and having a pair of axially spaced seal rings snugly engaging the inner wall of the valve housing in the upstream chamber.

5. The backflow-preventing valve defined in claim 4 wherein the piston flange is provided between the seal rings with a U-section gland concave upstream toward the inlet and snugly engaging the inner wall.

6. The backflow-preventing valve defined in claim 1 wherein the check valve includes:

an annular seat generally between the chambers and defining a flow passage therebetween;

a valve body displaceable downstream toward the outlet away from the seat and upstream toward and into sealing engagement with the seat; and mounting means urging the valve body downstream against the seat.

7. The backflow-preventing valve defined in claim 1 wherein the spring is a coil spring surrounding the tubular piston and substantially out of the path of flow through the valve housing.

* * * * *